US008708218B2

(12) United States Patent
Bonnin et al.

(10) Patent No.: US 8,708,218 B2
(45) Date of Patent: Apr. 29, 2014

(54) PACKAGING FOR A FOOD PRODUCT THAT CAN BE DIVIDED INTO PORTIONS

(75) Inventors: Yves Bonnin, Maule (FR); Sébastien Ravelet, Brno (CZ)

(73) Assignee: Bongrain S.A., Viroflay (FR)

( * ) Notice: Subject to any disclaimer, the term of this patent is extended or adjusted under 35 U.S.C. 154(b) by 571 days.

(21) Appl. No.: 12/944,879

(22) Filed: Nov. 12, 2010

(65) Prior Publication Data

US 2011/0108614 A1 May 12, 2011

(30) Foreign Application Priority Data

Nov. 12, 2009 (FR) ..... 09 05441

(51) Int. Cl.
*B65D 5/32* (2006.01)
*B65D 5/42* (2006.01)

(52) U.S. Cl.
USPC ..... 229/115; 229/122.23; 229/123.1; 229/245; 229/902; 229/906

(58) Field of Classification Search
USPC ..... 229/87.08, 107, 115, 122.21, 122.23, 229/123.1, 125.35, 245, 902, 906
See application file for complete search history.

(56) References Cited

U.S. PATENT DOCUMENTS

| | | | | |
|---|---|---|---|---|
| 2,191,517 | A * | 2/1940 | Carson | 229/122.23 |
| 2,626,095 | A * | 1/1953 | Brooks | 229/122.23 |
| 3,184,140 | A * | 5/1965 | Peterson | 229/122.21 |
| 3,195,803 | A * | 7/1965 | Ford | 229/87.08 |
| 3,935,943 | A * | 2/1976 | Meyer et al. | 229/122.23 |
| 4,971,243 | A * | 11/1990 | Lisiecki | 229/122.23 |
| 4,990,345 | A * | 2/1991 | Webb | 426/123 |
| 5,364,016 | A * | 11/1994 | Capy et al. | 229/107 |
| 5,735,454 | A * | 4/1998 | Jensen | 229/123.1 |
| 5,975,412 | A * | 11/1999 | Guillin | 229/122.22 |
| 2003/0017237 | A1 | 1/2003 | Poupard et al. | |
| 2007/0051784 | A1 * | 3/2007 | Money et al. | 229/115 |

FOREIGN PATENT DOCUMENTS

| | | |
|---|---|---|
| EP | 1 074 485 | 2/2001 |
| FR | 2 012 286 | 3/1970 |
| FR | 2 854 388 | 11/2004 |

* cited by examiner

*Primary Examiner* — Gary Elkins
(74) *Attorney, Agent, or Firm* — Clark & Brody

(57) ABSTRACT

Packaging that has a small space requirement after use, is economical and practical to use, and avoids the user soiling his fingers during opening and when grasping the product comprises a lateral strip (410) having two longitudinal edges connected by two end edges and having at least one curvature and/or fold in order to form a storage space for the food product and a membrane seal having a bottom region (501) and a cover region (502), each region begin secured to a separate longitudinal edge, and a lateral border region (503) secured to the end edges of the strip so as to enclose the food product in the storage space. The membrane seal is secured in a peelable manner to the end edges, to the whole of a first longitudinal edge and to at least a part of the second longitudinal edge.

15 Claims, 4 Drawing Sheets

F2
P 410
10
502
F3

F5
404
502
503
403
10
P

P
10
F6
503
502

F8
P
10
F7
501
503
502

L
500
L
500
L
500

600
601
602
603
604
700
701
702
703
704
705
706
707
710
711
712
713
714
715
716
717
F2
F3
F6
F7
F8
P
10

902
900
903
901
800

900
800

1103
1000
1002
1003
1001
1102
1104
1101
1100

1100
1001
1000
1103
1002
1003

1000
1100

1302
1300
1303
1301
1203
1201
1200
1202
1204

1300
1303
1203
1100

1300
1100

PACKAGING FOR A FOOD PRODUCT THAT CAN BE DIVIDED INTO PORTIONS

The invention relates to packaging for a food product P that can be divided into portions. This packaging can be obtained from a blank supplied flat and intended to be assembled in order to form the packaging. The blank can be in one or more parts, preferably two parts.

In the following description, the expression food product that can be divided into portions is understood as products that can be divided into portions in the cold or warm state, such as soft cheese, butter, chocolate, rillettes, etc.

Packaging of products of this kind has been known for many years.

For products that can be divided into portions in the cold state, such as butter, a metalized paper is used that is folded around the portion of product.

This packaging is not impervious since it is simply folded. There is thus a significant risk of contamination and as a result the use-by date (UBD) must be calculated. In addition, during the production of the packaging, product can escape through the folds and contaminate the production tool. Generally, when a user opens a pack of butter or an individual portion of butter, he will notice butter in the folds and must be careful not to be soiled thereby.

For products that can be divided into portions in the warm state, it is essential that the packaging be impervious. This is because such products are generally very fluid in the warm state, more fluid than in the cold state. Thus, if the packaging were not impervious, the product would immediately flow out of the packaging during manufacture.

Packaging made of thermoplastic or thermosetting material and heated in order to be thermoformed or sealed is known. For example, packaging of this kind is used for the products P'tit Louis® or Saint Moret®. This packaging is very expensive. Furthermore, it has a large space requirement since it retains its shape after use. It therefore has to be crushed in order to reduce its space requirement. Finally, demolding of the product can be difficult if the opening is not located in the middle of the product, such as for the products P'tit Louis®. This packaging is thus generally restricted to products in trays which are cut with a knife in the tray itself (Saint Moret®)

Packaging made of lacquered aluminum and used for triangular portions of soft cheese, such as the product described in patent WO 00/17064, is also known. This packaging has the advantage of being very economical.

This packaging comprises a receptacle having a bottom and lateral edges. It is obtained from a blank supplied flat and assembled in a retaining mold. It is not thermoformed but simply maintained in this shape.

The soft cheese is poured in the warm state into the receptacle. Next, a lacquered aluminum cover sheet is placed on the still warm product and a part of the lateral walls is folded over a part of the cover sheet. The latter is then held between the product itself and the folded part of the lateral walls.

The lateral walls are sealed on the cover sheet by applying pressure and heat in order to seal the lacquer.

This packaging has numerous drawbacks.

It can only be used with products that can be divided into portions in the warm state. Specifically, the pressure applied during sealing cannot be too high since it is applied indirectly to the product itself. The temperature of the product is thus used to promote sealing of the lacquer. A product that can be divided into portions in the cold state thus cannot be involved in the sealing process. In parallel, it is necessary to ensure that the temperature of the sealing iron does not impair the integrity of the product.

In addition, the use of packaging of this kind is not very practical and the user's fingers are often soiled when opening the packaging and removing the product to consume it.

Moreover, in the corners of the packaging, the lateral walls are not perfectly sealed on the cover sheet. Specifically, in the angles of the packaging, two lateral walls overlap one another on the cover sheet. Sealing is therefore bad between the sheet and the lateral wall with which it is in direct contact.

In addition, forming the sheet in a die generates very high stresses within the lacquered aluminum, which as a result has numerous microcracks. The packaging is thus not perfectly impervious and there is a high risk of contamination.

Moreover, aluminum only has a low mechanical strength and so it is a frequent occurrence that the user inadvertently squashes the packaging, bursting it open.

Finally, the blank necessary for producing this packaging has numerous cutouts which cause significant losses of material.

One solution to these problems of imperviousness and mechanical strength consisted in proposing packaging of similar form (same blank form) but made of thermoformed material. However, this packaging remains costly, has a large space requirement and is restricted to products that can be divided into portions in the warm state. In addition, it is difficult to demold the product.

It is thus an objective of the invention to provide packaging that has a small space requirement after use, is economical and practical to use and avoids the user soiling his fingers during opening and when grasping the product.

Another objective of the invention is to provide packaging that has a small space requirement after use, is economical, practical to use and multipurpose, i.e. can be used for a food product that can be divided into portions in the warm or cold state.

Another objective of the invention is to provide packaging that has a small space requirement after use, is economical, multipurpose, practical to use and has optimum imperviousness, including in the angles and the folds of the packaging.

To this end, the invention proposes the production of packaging from a blank of foldable material, the arrangement of which enables impervious sealing of all the edges, and enabling a sealing temperature and pressure to be applied away from the product.

More specifically, the subject of the invention is foldable packaging for a food product that can be divided into portions, comprising, with reference to the assembled packaging:

- a lateral strip having two longitudinal edges connected by two end edges and having at least one curvature and/or fold in order to form a storage space for the food product,
- a membrane seal having a bottom region and a cover region each secured to a separate longitudinal edge, and a lateral border region secured to the end edges of the strip so as to enclose the food product in the storage space, the membrane seal being secured in a peelable manner to the end edges, to the whole of a first longitudinal edge and to at least a part of the second longitudinal edge.

Foldable packaging stands in contrast to thermoformed packaging. Foldable packaging is produced from one or more flat blanks comprising fold lines and/or cutouts and/or slit-score lines. This or these flat blanks are then assembled by folding in order to produce the packaging.

In contrast, thermoformed packaging is produced from a sheet of thermoformable material heated and assembled in a mold.

Packaging for a food product consists of structures made of material(s) and having thickness(es) enabling them to be opened by hand (by unfolding or by tearing back). For example, packaging of this kind can consist of sheets of aluminum having a thickness of less than 50 μm, sheets of paper or board having a basis weight less than 450 grams per square meter, sheets of polypropylene, polyethylene or polyester having a thickness of less than 100 μm.

The term "lateral" designates the fact that, when the bottom of the assembled packaging is placed on a substrate, the strip and the border region of the membrane seal delimit the packaging laterally.

The lateral strip is intended to be grasped by a user in order to hold the food product, while the membrane seal is intended to be peeled and removed (even if it can remain secured to the strip). This strip has the form of a planar web when it is flat. In other words, the strip has a greater length along a longitudinal axis than the width along the transverse axis.

Preferably, the form of the strip when flat is approximately rectangular, i.e. it has longitudinal edges which are longer than the end edges. An "approximately" rectangular form is a form having two longitudinal edges which are longer than the end edges, it being possible for all of these edges to be rectilinear or to have one or more curves or ridges. The expression "approximately rectangular" also covers a trapezoidal form of the strip (where one of the end edges is narrower than the second end edge or the center of the strip).

Similarly, the end edges can be reduced to a simple point such that the two longitudinal edges intersect at the end of the strip. In other words, the strip has, at its ends, a pointed form of which the sides consist of at least a part of the longitudinal edges and the tip consists of a punctiform end edge. In this configuration, the lateral border region of the membrane seal is reduced to a simple fold line.

When the packaging is assembled, the strip is shaped so as to have a curvature and/or fold. In other words, the strip has, in the assembled form, at least two planes, or even infinite planes if the strip is curved.

The term "peelable" is understood to mean securing in an impervious manner by adhesive bonding or sealing, enabling the manual separation, in normal use of the packaging, of the two pieces secured in this way, without tearing them.

According to particular embodiments:

- the lateral strip may have a fold line so as to form at least two non-coplanar securing flat parts extending along the end edges and the first longitudinal edge;
- the strip may have at least one cutout joining one longitudinal edge to the fold line and, when the packaging is assembled, separating two securing flat parts;
- the strip may have a bonding region delimited by two folds and including a fold separating said bonding region into two complementary portions intended to be adhesively bonded to one another in order to form a gripping lug;
- the strip may have two opening fold lines extending between the two longitudinal edges;
- the packaging may comprise a material selected from the group consisting of hot-melt materials, such as polyolefins, polyamides and polyesters, a laminate complex comprising at least one sheet of paper or board and at least one sheet of a hot-melt material, and a combination of these materials;
- the packaging may comprise a material covered, at least partially, with an adhesive;
- said material may be selected from, the group consisting of paper, board, aluminum and a plastic sheet, and the adhesive can be selected from a hot-melt resin and a heat-sealing lacquer;
- the membrane seal may comprise at least one pull tab;
- the membrane seal may have a stiffness less than or equal to that of the strip;
- the packaging may be formed from a blank made of foldable material supplied flat and assembled in order to form the packaging, the blank being in two separate parts intended to be secured to one another, a first part forming the strip, the second part forming the membrane seal;
- the fold line may extend over the lateral strip so as to form, in addition, at least two securing flat parts along at least a part of the second longitudinal edge.

The invention also relates to a method for producing packaging as above, comprising the following steps:

- assembling the packaging in order to form a storage space for the food product;
- securing the membrane seal in a peelable manner to the end edges, to the whole of a first longitudinal edge and to at least a part of the second longitudinal edge.

According to particular embodiments:

- the step of securing the membrane seal to the strip may be carried out by means of securing flat parts arranged approximately parallel to the bottom and directed toward the outside with respect to the storage space for the food product;
- the method may comprise the following steps:
  - A1) folding the strip such that it has at least one curvature and/or fold in order to form a storage space for the food product and placing a first longitudinal edge of the strip thus formed at the periphery of the bottom region of the membrane seal;
  - B1) securing in a peelable manner, by adhesive bonding or sealing, the first longitudinal edge of the strip to the bottom region of the membrane seal;
  - C1) partially flapping down the membrane seal and securing in a peelable manner, by adhesive bonding or sealing, the two end edges of the strip to the lateral border region of the membrane seal so as to close the storage space laterally;
  - D1) placing the food product onto the bottom region in the storage space;
  - E1) flapping down the cover region of the membrane seal onto the second longitudinal edge of the strip and securing them in a peelable manner, by adhesive bonding or sealing, to at least a part of the second longitudinal edge arranged in alignment with the end edges.

Further features of the invention will be set out in the following detailed description, given with reference to the appended figures, in which, respectively:

FIGS. 1 to 10 show a first form of a second embodiment of packaging according to the invention, in which:

FIG. 1 illustrates a schematic plan view of the first form of the second embodiment of packaging according to the invention, presenting a first variant in the form of the strip;

Figures 1, 1A, 1B, 1C, 2, 2A, 3, 4, 5:
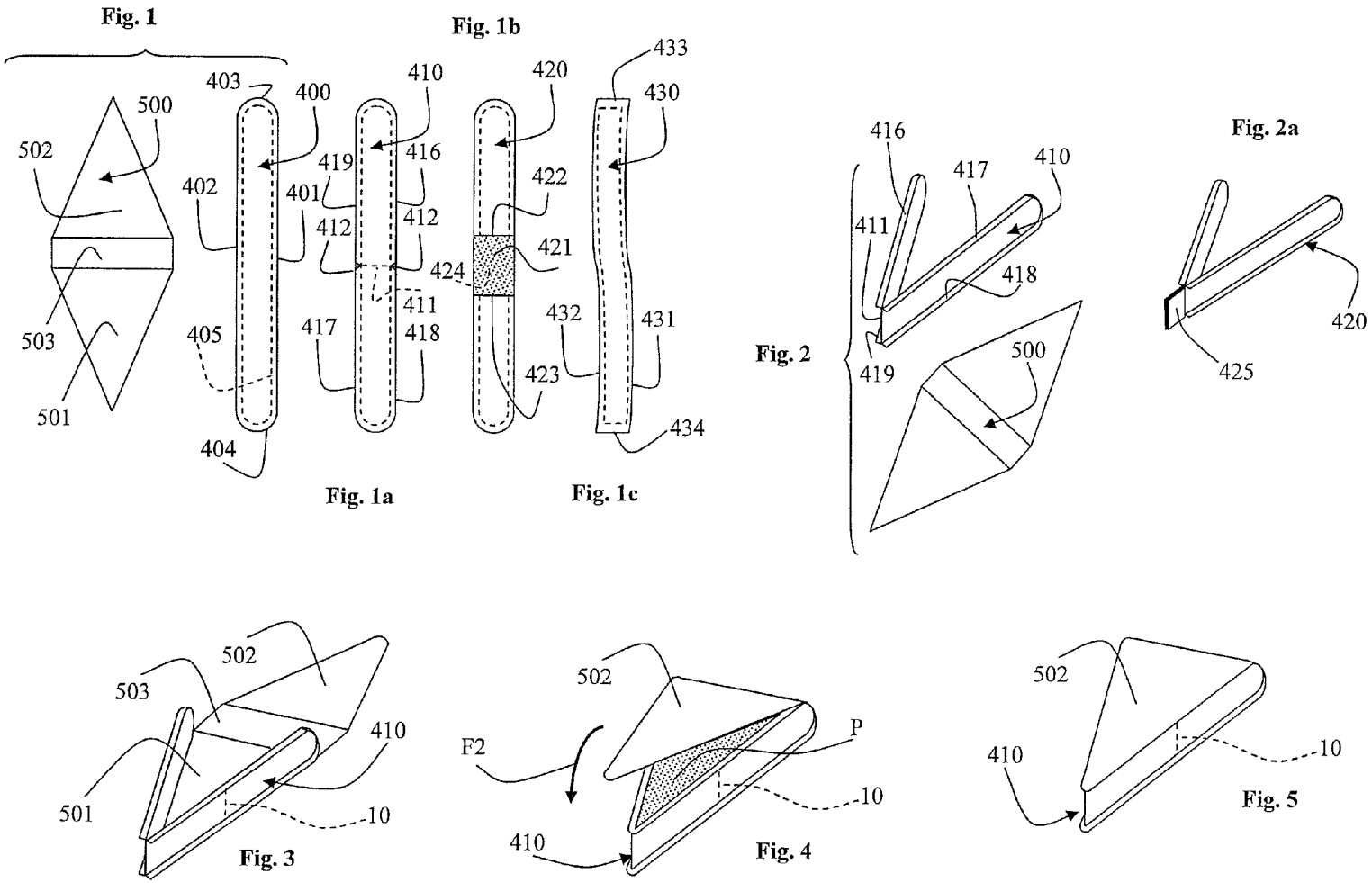

FIGS. 1*a*, 1*b* and 1*c* illustrate three other variants in the form of the strip of the second embodiment of packaging according to the invention;

FIG. 2 illustrates a schematic perspective view of the assembling of the packaging in FIG. 1;

FIG. 2*a* illustrates a schematic perspective view of the assembling of the strip in FIG. 1*b;*

Figures 6, 7, 8, 9, 10:
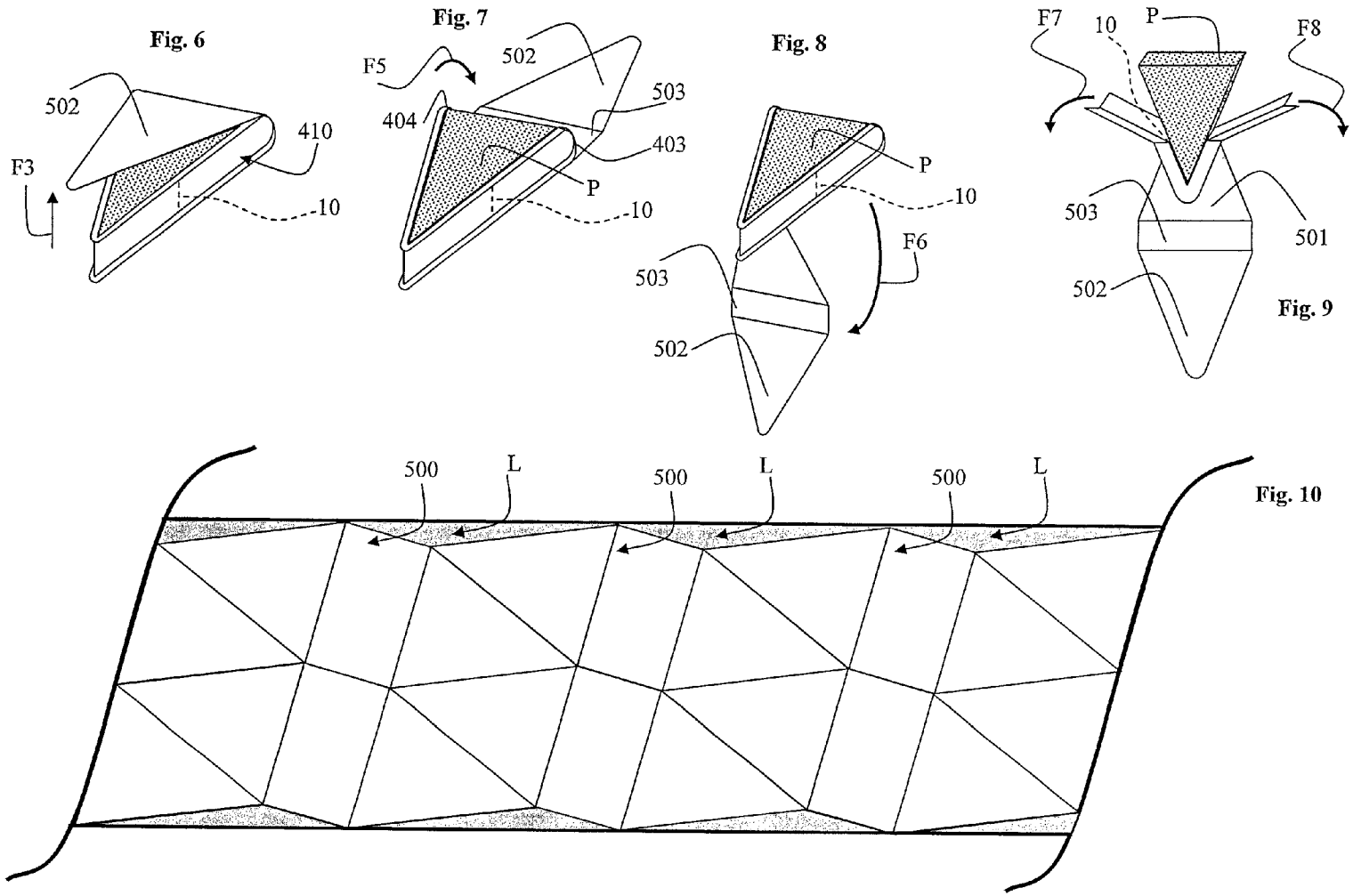
Figures 11, 11A, 12, 13, 14, 15, 16, 17, 18:
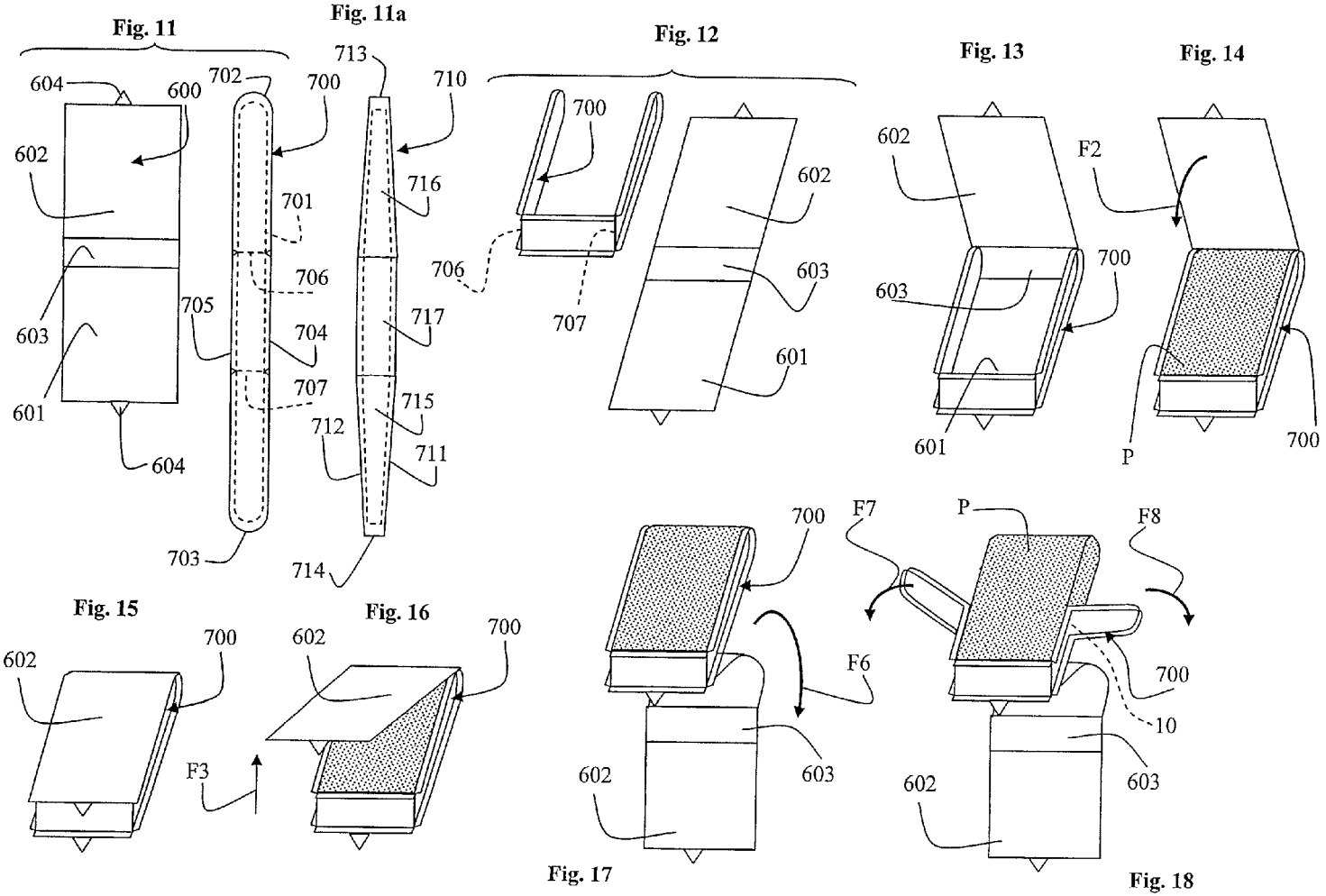
Figures 19, 20, 21, 22, 23, 24, 25, 26:
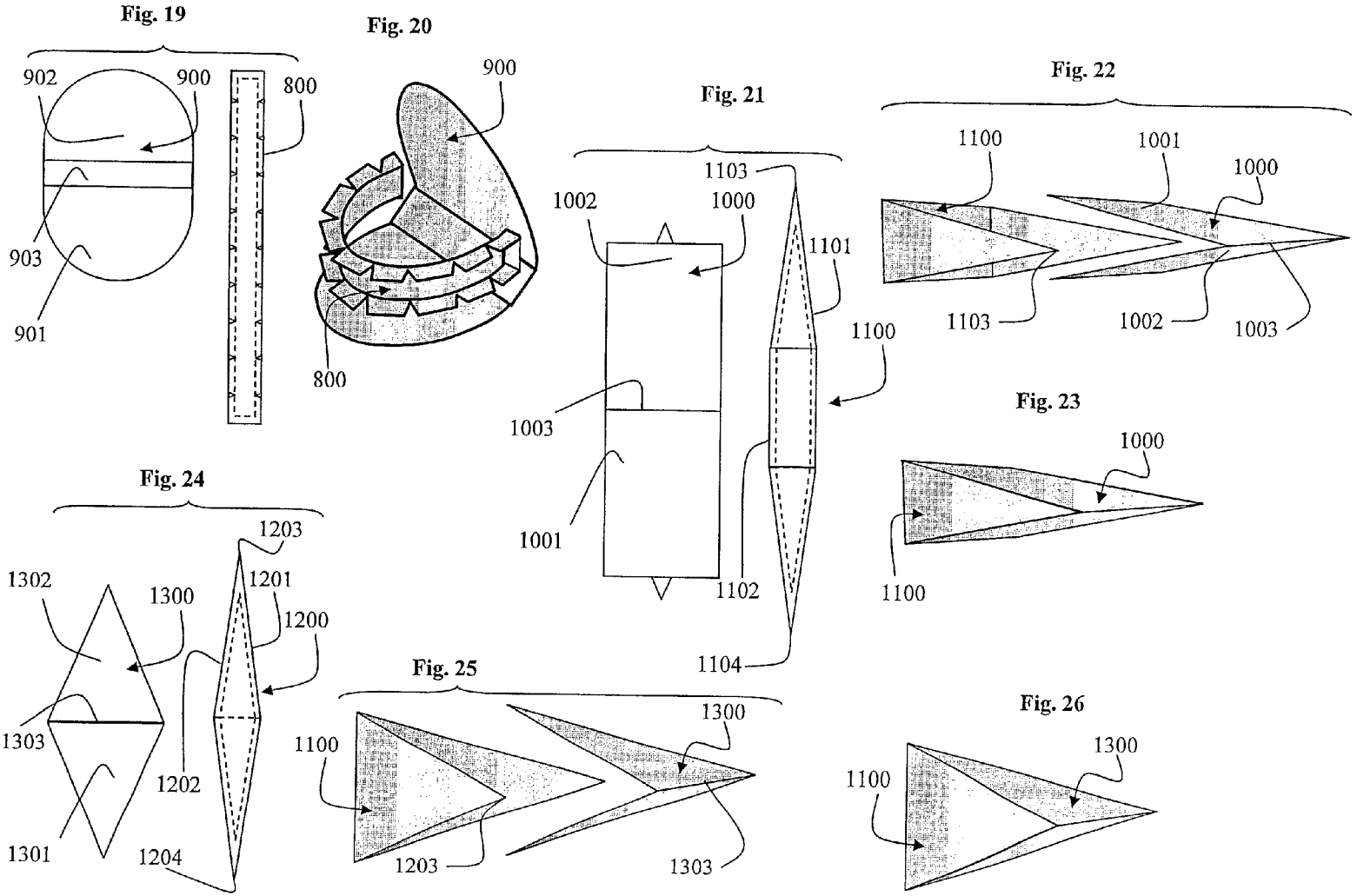

FIGS. 3 to 5 illustrate schematic perspective views of the closure of the packaging in FIG. 2;

FIGS. 6 to 9 illustrate schematic perspective views of the opening of the packaging in FIG. 2;

FIG. 10 illustrates an example of the cutting-out arrangement of a plurality of membrane seals of the first form of the second embodiment of packaging according to the invention, limiting wastage of material during manufacture;

FIGS. 11 to 18 show a second form of the second embodiment of packaging according to the invention, in which:

FIG. 11 illustrates a schematic plan view of the second form of the second embodiment of packaging according to the invention, presenting a first variant in the form of the strip;

FIG. 11*a* illustrates a second variant in the form of the strip of the second form of the second embodiment of packaging according to the invention;

FIG. 12 illustrates a schematic perspective view of the assembling of the packaging in FIG. 11;

FIGS. 13 to 15 illustrate schematic perspective views of the closure of the packaging in FIG. 11;

FIGS. 16 to 18 illustrate schematic perspective views of the opening of the packaging in FIG. 11;

FIGS. 19 and 20 show a third form of the second embodiment of packaging according to the invention;

FIGS. 21 to 23 show a fourth form of the second embodiment of packaging according to the invention; and FIGS. 24 to 26 show a fifth form of the second embodiment of packaging according to the invention.

A second preferred embodiment of packaging according to the invention is illustrated in FIGS. 1 to 26. FIGS. 1*a*, 1*b* and 1*c* illustrate variants in the form of the strip.

According to a first form illustrated in FIGS. 1 to 9, the foldable packaging according to the invention comprises, with reference to the assembled packaging:

- a lateral strip 400 intended to be grasped by the user and having two longitudinal edges 401 and 402 which are connected by two end edges 403 and 404; and
- a membrane seal 500 having a bottom region 501, a cover region 502 and a lateral border region 503.

In the variant illustrated in FIG. 1, the end edges 403 and 404 of the strip 400 are curved.

The lateral strip 400 has a fold line 405 extending parallel to the end edges and to the two longitudinal edges so as to form at least two non-coplanar securing flat parts.

In the strip 410 in FIG. 1*a*, a fold line 411 is provided approximately in the middle of the strip. This fold line 411 is intended to be located between the two points (at the top and the bottom) of the membrane seal (see FIG. 2). In addition, the strip 410 comprises two cutouts 412 joining a longitudinal edge, 401-402 respectively, to the fold line 405 and, when the packaging is assembled, separating two securing flat parts 416-417 and 418-419 (see FIG. 2).

The strip 420 in FIG. 1*b* has a bonding region 421 delimited by two folds 422 and 423. The bonding region 421 also comprises a fold 424 separating said region into two complementary portions intended to be adhesively bonded to one another in order to form a gripping lug. FIG. 2*a* illustrates this strip 420 in the assembled state. The user can grasp the gripping lug 425 between two fingers.

The lateral strip 430 in FIG. 1*c* has two longitudinal edges 431-432 having two curves. In addition, the strip 430 has two rectilinear end edges 433-434.

FIG. 2 illustrates the strip from FIG. 1*a* assembled above the membrane seal 500. In order to form the packaging, the strip 410 is folded such that it has a fold in order to form a storage space for the food product. Next, one longitudinal edge is placed at the periphery of the bottom region 501 of the membrane seal 500. In the embodiment illustrated, the longitudinal edges have securing flat parts 416-417, 418-419. It is thus these flat parts which are located at the periphery of the bottom region 501 of the membrane seal 500.

Next, the first longitudinal edge of the strip is secured in a peelable manner, by adhesive bonding or sealing, to the bottom region of the membrane seal. When the strip carries securing flat parts, it is these that are secured to the membrane seal. The result is illustrated in FIG. 3.

Next, the membrane seal 500 is partially flapped down and the two end edges of the strip are secured in a peelable manner to the lateral border region 503 of the membrane seal 500. Thus, the storage space is closed laterally. It is thus possible to place the food product P onto the bottom region 501, between the lateral strip and the lateral border region of the membrane seal.

Once the product P has been placed in the storage space, the cover region 502 is flapped down and secured in a peelable manner to at least a part of the second longitudinal edge of the strip arranged in alignment with the end edges (FIG. 4). The result is illustrated in FIG. 5, which shows the closed packaging. In this way, when the user opens the packaging, he can tear back the membrane seal along one entire longitudinal edge, along the two end edges and along a part, at least, of the second longitudinal edge (see FIGS. 6 to 8).

When the user wishes to consume the product P, he grasps the packaging according to the invention by placing his fingers on the lateral walls formed by the lateral strip 410 according to the invention. Since the cover region 502 is secured in a peelable manner to the securing flat parts 416-417, the user can detach the cover region 502 from the lateral walls of the strip. For this purpose, as illustrated in FIG. 6, he grasps one end of the membrane seal and lifts the membrane seal 502 in the direction of the arrow F3.

This end of the cover region can carry a pull tab in order to aid grasping and opening. A distinction is made between such a pull tab according to the invention and a Tircel (or easy opening tape) of the prior art, in that the tab does not tear the packaging, and in particular the cover region, but remains secured to this region. Thus, by virtue of the pull tab and the peelable (i.e. non-tearable) securing, the user separates two parts of the packaging along a securing region between these two parts but does not tear them, these parts retaining their integrity.

In addition, the pull tab according to the invention is located on a small part of the packaging and is preferably an integral part of the packaging. By contrast, the Tircel has to be attached to the packaging and arranged along the entire length of the region to be torn. As soon as the Tircel stops, tearing ends. Tircels are expensive, on account of their length, and must be positioned precisely, making manufacture expensive and tricky.

The user continues to open the packaging according to the invention by pulling the cover region 502 along the arrow F5 (FIG. 7). At this stage, the lateral border region 503 connected to the cover region 502 is detached from the two end edges 403-404 of the lateral strip 410.

According to the invention, the user continues the opening movement along the arrow F6 (FIG. 8), separating at least a part of the bottom region 501 from the lateral strip 410.

Preferentially, as illustrated in FIG. 9, the lateral strip 410 carries two fold lines 10 connecting the two longitudinal edges. These fold lines enable the user, who is holding the packaging by the strip, for example between thumb and index finger, to separate a part of this strip along the arrows F7 and F8 in order to be able very easily to put the product P into his mouth or onto a substrate without having to touch it with his fingers.

This second embodiment makes it possible to obtain triangular packaging which only generates little waste during manufacture. Specifically, as shown in FIG. 10, the membrane seals 500 have a symmetrical form making it possible to produce a plurality of membrane seals in an interlocking manner on a single web of material. Waste material L, illustrated in gray in FIG. 10, represents a much smaller surface area than the waste generated by the packaging described in patent WO 00/17064.

This is all the more true when the membrane seal and the strip are rectangular.

FIGS. 11 to 18 illustrate a second possible form obtained with the second preferred embodiment of the invention.

In FIG. 11, the membrane seal 600 has a bottom region 601 and a cover region 602 which are approximately rectangular. These regions are connected by a lateral border region 603 which is also rectangular. In this FIG. 11, the bottom region 601 and the cover region 602 each have a pull tab 604. These pull tabs 604 make it possible to open the packaging either by the bottom region or by the cover region without tearing the membrane seal. In this case, the membrane seal is secured in a peelable manner to the end edges, to the entire first longitudinal edge and to the entire second longitudinal edge of the strip 700.

This strip 700 has a fold line 701 extending parallel to the end edges 702-703 and to the two longitudinal edges 704-705. In this way, when the strip is assembled, securing flat parts are arranged approximately parallel to the bottom region 601 and approximately perpendicular (i.e. at 90 degrees, plus or minus about 5 degrees) to the part of the strip that forms the lateral walls of the packaging.

The strip 700 also comprises two fold lines 706-707 for forming, when the lateral strip is assembled, a storage space for the food product P. At the end of these two fold lines 706-707, the strip has a cutout joining a longitudinal edge 704-705 to the fold line 701. These cutouts 708 enable the separation of the securing flat parts from one and the same longitudinal edge while the strip is folded. This is illustrated in FIG. 12.

FIG. 11*a* illustrates a variant of the strip 710 having two longitudinal edges 711-712 each having three non-aligned segments. The two longitudinal edges 711-712 are connected to one another by end edges 713-714 which are narrower than the center of the strip where the longitudinal edges are parallel. In other words, the strip has two trapezoids 715-716 arranged on either side of a rectangle 717.

As in FIGS. 3 to 9, FIGS. 13 to 18 illustrate the assembling of the packaging (FIG. 13), the filling of the packaging with the food product P, the closure of the packaging (FIGS. 14 and 15) and the opening of the packaging (FIGS. 16 to 18) in the case of rectangular packaging.

In all the examples cited in the present description, the membrane seal is secured in a peelable manner to the two end edges, to the whole of a first longitudinal edge and to at least a part of the second longitudinal edge.

When the cover region is secured in a peelable manner to only a part of the second longitudinal edge, the other part of this longitudinal edge is secured firmly, i.e. without it being possible to separate the membrane seal from the strip along this part without having to tear one and/or the other.

However, preferably, the membrane seal is secured in a peelable manner all along the two longitudinal edges of the strip. In this way, the user can open the packaging according to the invention either by the bottom or by the cover of the membrane seal, as if he were peeling a banana.

This opening method and the features of the packaging enabling this method to be implemented make it possible to obtain packaging that is very easy to use, economical to manufacture and very hygienic, since the user never touches the product and can consume it directly from the packaging by putting it into his mouth without having touched it with his fingers.

FIGS. 19 to 20 show a third, semicircular packaging. In this form, the strip has a continuous curvature forming a storage space for the food product. Here, too, the strip has a fold line parallel to all of its edges, enabling the production of securing flat parts on the bottom region, the cover region and the lateral border region of the membrane seal 900.

The fourth form illustrated in FIGS. 21 to 23 illustrates a membrane seal 1000 having a bottom region 1001 and a cover region 1002 which are connected by a lateral border region 1003 reduced to a simple fold line. In a complementary manner, the strip 1100 has two longitudinal edges 1101-1102 each having three non-aligned segments. The two longitudinal edges 1101-1102 are connected to one another by end edges 1103 and 1104 which are each limited to a simple point. In other words, the longitudinal edges 1101 and 1102 intersect and form two points.

Thus, when the packaging is assembled (FIG. 23), the points 1103 and 1104 of the strip 1100 coincide with the linear lateral border region 1003 of the membrane seal 1000. The securing flat parts have not been shown in FIG. 22 for the sake of clarity.

To produce the packaging, the strip 1100 is folded as illustrated in FIG. 22 and is secured in a peelable manner to the bottom region 1002 of the membrane seal 1000. Next, the space delimited by the strip and the bottom region is filled with the product P. Finally, the cover region 1001 is flapped down and is secured in a peelable manner, at least partially but preferably completely, to the strip 1100. The packaging obtained is illustrated in FIG. 23.

FIGS. 24 to 26 illustrate packaging according to the invention having the form of a pyramid-shaped carton when it is assembled.

To this end, the packaging comprises a strip 1200 having two longitudinal edges 1201-1202, each formed by two non-colinear segments. These two longitudinal edges 1201-1202 are connected by two end edges 1203-1204 which are limited to a simple point. In other words, the strip is diamond-shaped. The packaging also comprises a membrane seal 1300 having a triangular bottom region 1301 and a triangular cover region 1302 which are connected to one another by a lateral border region 1303 formed by a simple fold line. In other words, the membrane seal 1300 is also diamond-shaped.

The securing flat parts have not been illustrated in FIGS. 25 and 26 for the sake of clarity.

Thus, when the packaging according to the invention is assembled, each securing flat part is arranged approximately parallel to the bottom and directed toward the outside of the assembled blank, protruding with respect to the planes formed by the lateral walls. In this position, the securing flat part has a closure surface (by sealing or peelable adhesive bonding) which is directed upward, i.e. away from the bottom. The cover region can thus be secured above the bottom region, on the securing flat parts and away from the product P.

In this way, during manufacturing, by virtue of a counter-pressure means (not illustrated) located under the flat parts, it is possible to apply a high securing pressure to the cover and to the securing flat parts. This pressure is, therefore, never applied directly or indirectly to the product P contained in the storage space. Similarly, it is possible to locally heat the membrane seal and the securing flat parts during this application of pressure without risking heating the product.

This packaging structure thus makes it possible to package, in the warm state and in the cold state, products that can be divided into portions, such as butter or cooked meats, while ensuring perfectly impervious packaging.

In addition, the securing flat parts serve as an abutment for the user's fingers during the opening of the packaging. Specifically, when the membrane seal is torn back along an entire first longitudinal edge, along the two end edges and along at least a part of the second longitudinal edge, the packaging can slip in the user's hands. Providing securing flat parts on one longitudinal edge, or preferably on both longitudinal edges, prevents the packaging from slipping while it is being opened.

Advantageously, the membrane seal has a stiffness less than that of the strip. Thus, while the packaging is being opened by the user, the strip is more resistant to mechanical deformations than the membrane seal.

This avoids any squashing of the packaging in the user's bag. It also enables the manufacture of less expensive packaging while ensuring that the strip retains its shape during opening. Thus, after opening, the user can hold between his fingers the strip which contains the food product.

The invention claimed is:

1. Foldable packaging for a food product that can be divided into portions, comprising, with reference to the assembled packaging:

a lateral strip (400, 410, 420, 430, 700, 710, 800, 1100, 1200) having two, a first and a second longitudinal edges (401-402, 431-432, 704-705, 711-712, 1101-1102, 1201-1202) connected by two end edges (403-404, 433-434, 702-703, 713-714, 1104-1105, 1204-1205) and having at least one curvature and/or fold (411, 424, 706-707) in order to form a storage space for the food product (P), a membrane seal (500, 600, 900, 1000, 1300) having a bottom region (501, 601, 901, 1001, 1301) and a cover region (502, 602, 902, 1002, 1302) each secured to one of said first and second longitudinal edges of the lateral strip, and a lateral border region (503, 603, 903, 1003, 1303) secured to the end edges of the strip so as to enclose the food product in the storage space, the membrane seal being secured in a peelable manner to the end edges, to the whole of one of said first and second longitudinal edges and to at least a part of the other of said first and second longitudinal edges.

2. Packaging according to claim 1, in which the lateral strip has a longitudinal fold line (405, 701) so as to form at least two non-coplanar securing flat parts extending along the end edges and the first longitudinal edge.

3. Packaging according to claim 1, in which the strip has at least one cutout (412) joining one of said first and second longitudinal edges to the longitudinal fold line and separating two securing flat parts of the assembled packaging.

4. Packaging according to claim 1, in which the strip has a bonding region (421) delimited by two transversal folds (422, 423) and including a third transversal fold (424) separating said bonding region into two complementary portions adhesively bonded to one another in order to form a gripping lug.

5. Packaging according to claim 1, in which the strip has two opening fold lines (10) extending between the two longitudinal edges.

6. Packaging according to claim 1, comprising a material selected from the group consisting of hot-melt materials, such as polyolefins, polyamides and polyesters, a laminate complex comprising at least one sheet of paper or board and at least one sheet of a hot-melt material, and a combination of these materials.

7. Packaging according to claim 1, comprising a material covered, at least partially, with an adhesive.

8. Packaging according to claim 7, in which said material is selected from the group consisting of paper, board, aluminum and a plastic sheet, and the adhesive can be selected from a hot-melt resin and a heat-sealing lacquer.

9. Packaging according to claim 1, in which the membrane seal comprises at least one pull tab (7*a*).

10. Packaging according to claim 1, in which the membrane seal has a stiffness less than or equal to that of the strip.

11. Packaging according to any claim 1, formed from a blank made of foldable material supplied flat and assembled in order to form the packaging, the blank being in two separate parts intended to be secured to one another, a first part (400, 410, 420, 430, 700, 710, 800, 1100, 1200) forming the strip, the second part (500, 600, 900, 1000, 1300) forming the membrane seal.

12. Packaging according to claim 3, in which the fold line (405, 701) extends over the lateral strip so as to form, in addition, at least two securing flat parts along at least a part of the second longitudinal edge.

13. Method for producing packaging for a food product that can be divided into portions according to claim 1, comprising the following steps:

assembling the packaging in order to form a storage space for the food product;

securing the membrane seal in a peelable manner to the end edges, to the whole of a first longitudinal edge and to at least a part of the second longitudinal edge.

14. Method according to claim 13, in which the step of securing the membrane seal to the strip is carried out by means of securing flat parts arranged approximately parallel to the bottom (501, 601, 901, 1001, 1301) and directed toward the outside with respect to the storage space for the food product.

15. Method for producing packaging for a food product that can be divided into portions according to claim 13, comprising the following steps:

A1) folding the strip (400, 410, 420, 430, 700, 710, 800, 1100, 1200) such that it has at least one curvature and/or fold (411, 424, 706-707) in order to form a storage space for the food product and placing a first longitudinal edge (401, 431, 704, 711, 1101, 1201) of the strip thus formed at the periphery of the bottom region (501, 601, 901, 1001, 1301) of the membrane seal (500, 600, 900, 1000, 1300);

B1) securing in a peelable manner, by adhesive bonding or sealing, the first longitudinal edge (401, 431, 704, 711, 1101, 1201) of the strip to the bottom region (501, 601, 901, 1001, 1301) of the membrane seal (500, 600, 900, 1000, 1300);

C1) partially flapping down the membrane seal (500, 600, 900, 1000, 1300) and securing in a peelable manner, by adhesive bonding or sealing, the two end edges (403-404, 433-434, 702-703, 713-714, 1104-1105, 1204-1205) of the strip to the lateral border region (503, 603, 903, 1003, 1303) of the membrane seal so as to close the storage space laterally;

D1) placing the food product (P) onto the bottom region (501, 601, 901, 1001, 1301) in the storage space;

E1) flapping down the cover region (502, 602, 902, 1002, 1302) of the membrane seal onto the second longitudinal edge (402, 432, 705, 712, 1102, 1202) of the strip and securing them in a peelable manner, by adhesive bonding or sealing, to at least a part of the second longitudinal edge arranged in alignment with the end edges.

* * * * *